US010544564B2

(12) United States Patent
Tsuneyoshi et al.

(10) Patent No.: US 10,544,564 B2
(45) Date of Patent: Jan. 28, 2020

(54) SHOVEL-TYPE CONSTRUCTION MACHINE

(71) Applicant: Caterpillar SARL, Geneva (CH)

(72) Inventors: Takeshi Tsuneyoshi, Akashi (JP); Takahiro Iwamoto, Akashi (JP); Takeshi Nakamura, Akashi (JP); Akito Nakai, Akashi (JP); Kentaro Nakayama, Akashi (JP); Dharmesh Kumar, Akashi (JP); Koichi Andatsu, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 16/099,469

(22) PCT Filed: May 12, 2017

(86) PCT No.: PCT/EP2017/061488

§ 371 (c)(1),
(2) Date: Nov. 7, 2018

(87) PCT Pub. No.: WO2017/198566

PCT Pub. Date: Nov. 23, 2017

(65) Prior Publication Data

US 2019/0153700 A1 May 23, 2019

(30) Foreign Application Priority Data

May 19, 2016 (JP) ..... 2016-100214

(51) Int. Cl.
*E02F 9/08* (2006.01)
*E02F 9/16* (2006.01)

(52) U.S. Cl.
CPC ..... *E02F 9/0816* (2013.01); *E02F 9/166* (2013.01)

(58) Field of Classification Search
None
See application file for complete search history.

(56) References Cited

U.S. PATENT DOCUMENTS 5,984,036 A 11/1999 Higuchi et al.
2006/0117946 A1* 6/2006 Dubreuil ..... B66C 3/005 92/106

FOREIGN PATENT DOCUMENTS

JP 3441936 B2 9/2003
JP P2008184820 A 8/2008
JP 5798097 B2 10/2015

OTHER PUBLICATIONS

International Search Report for related International Application No. PCT/EP2017/061488; dated Aug. 22, 2017.

* cited by examiner

*Primary Examiner* — Ronald P Jarrett

(57) ABSTRACT

The present invention aims to improve the strength of the portion of the swing frame for attaching the swing motor apparatus while reducing cost. A bottom plate of a swing frame is divided into a center bottom plate segment to which the swing motor apparatus mounting portion is attached, a front bottom plate segment that is positioned to the front side of the center bottom plate segment and to which the center joint mounting portion is attached, and a rear bottom plate segment positioned to the rear side of the center bottom plate segment, wherein: the center, front, and rear bottom plate segments and are formed integrally by welding; and the plate thickness of the center bottom plate segment is thicker than the plate thickness of the front bottom plate segment and the rear bottom plate segment.

1 Claim, 5 Drawing Sheets

SHOVEL-TYPE CONSTRUCTION MACHINE

FIELD OF THE INVENTION

The present invention relates to the technical field of shovel-type construction machines such as hydraulic shovels and the like.

BACKGROUND ART

In general, shovel-type construction machines such as hydraulic shovels and the like are configured such that an upper swing body is supported so as to be freely rotatable above a base carrier via a swing bearing; wherein, a swing frame, which serves as a base for said upper swing body, is provided with a bottom plate on which the swing bearing is mounted, a pair of left and right vertical frames (vertical plates) erected from said bottom plate for supporting an operation apparatus with which the upper swing body is equipped, and the like.

The swing bearing is attached to the bottom plate of the swing frame, as are a center joint for performing supply and drainage of hydraulic oil between the upper swing body and the base carrier, a swing motor apparatus for driving the swing bearing, and the like; however, the swing motor apparatus mounting portion of said bottom plate is a place where a large amount of stress is concentrated during rotation, wherefore it has been conventional practice to stack and weld a reinforcement plate on top of the bottom plate to obtain a doubling structure for reinforcement. When doing so, a seating surface for mounting the swing motor apparatus is formed on the reinforcement plate, that is, the reinforcement plate serves as a seat plate for mounting the swing motor apparatus; here, prior art configurations in which the reinforcement plate (seat plate for mounting the swing motor apparatus) is disposed extending in the left-right direction, and the left and right end portions of said reinforcement plate are welded to the inner side surfaces of the pair of left and right vertical plates erected on the bottom plate (e.g., Patent Document 1).

Further, in construction machines in which the swing motor apparatus is disposed further to the front side than the center joint, prior art configurations are also known in which the swing motor apparatus mounting portion is made as a thicker portion by making the plate thickness thereof thicker than that of the center joint mounting portion, and both the left and right end portions of said thicker portion are welded to the left and right vertical plates (e.g., Patent Document 2). In the construction machine described in Patent Document 2, a steel plate member having the plate thickness of the swing motor apparatus mounting portion is subjected to a milling process or the like on the portions thereof other than the swing motor apparatus mounting portion in order to remove material therefrom and make said portions thinner in plate thickness, whereby the swing motor apparatus mounting portion is made a thick portion.

CITATION LIST

Patent Literature

Patent Document 1: Japanese patent publication No. 3441936

Patent Document 2: Japanese patent publication No. 5798097

SUMMARY OF THE INVENTION

Problems to be Solved by the Invention

However, when the swing frame bottom plate mounting portion for the swing motor apparatus has been configured in a doubling structure by stacking and welding a reinforcement plate on the upper surface of the bottom plate, as described above, even if the circumference of the reinforcement plate is welded, because the abutting surfaces of the bottom plate and the reinforcement plate are not welded together, a gap may form between the bottom plate and the reinforcement plate due to weld distortion, etc. In particular, a problem has occurred in that when the left and right ends of the reinforcement plate have been welded to the inner side surfaces of the left and right vertical plates, as described in Patent Document 1, it becomes easier for a gap to form between the bottom plate and the reinforcement plate due to the synergistic effect of weld distortion in the left and right vertical plates; furthermore, when there is a gap between the bottom plate and the reinforcement plate, the load placed on the bottom plate and the reinforcement plate acts so as to expand the gap, which causes cracks to form in the welded portion of the circumference of the reinforcement plate, resulting in a loss of strength of the motor apparatus mounting portion.

Here, bolts for mounting the swing motor apparatus are fastened to the reinforcement plate from the upper side thereof, and bolts for mounting the swing bearing are fastened to the bottom plate from the bottom side thereof; however, if such bolts are provided so as to span the bottom plate and the reinforcement plate, there is a risk that the bolts will become loose, break, etc., wherefore the swing motor apparatus mounting bolts are fastened only to the reinforcement plate, and the swing bearing mounting bolts are fastened only to the bottom plate, resulting in a state of affairs in which it is difficult to strengthen the fastness between the bottom plate and reinforcement plate by the above-described bolts.

Meanwhile, in the case where the swing motor apparatus mounting portion has been strengthened by making the plate thickness thereof thick, as described in Patent Document 2, problems such as those in the above-described Patent Document 1 do not occur; however, in order to increase the thickness of the plate thickness of the swing motor apparatus mounting portion, the portions of the steel plate member other than the swing motor apparatus mounting portion are subject to a milling process for removing material therefrom to make said portions thin, wherefore there are problems in that time and effort are consumed by the milling process, the yield rate of the materials becomes poor, causing increased costs, and problems to be solved by the present invention are found therein.

Means for Solving the Problems

In light of the foregoing circumstances, the present invention was created with the object of solving the above-described problems. The invention according to claim 1 is a shovel-type construction machine comprising a bottom plate for configuring a swing frame of an upper swing body, and supporting the upper swing body on a base carrier in a manner such as to be freely rotatable via a swing bearing, said bottom plate having mounted thereon the swing bearing, a center joint that is disposed at a rotational center of the swing bearing and performs the supplying and draining of hydraulic oil between the base carrier and the upper swing body, and a swing motor apparatus that is disposed to the rear side of the center joint and performs driving of the swing bearing, wherein: the bottom plate is divided into a center bottom plate segment to which the swing motor apparatus mounting portion is attached, a front bottom plate segment that is positioned to the front side of the center bottom plate segment and to which the center joint mounting portion is attached, and a rear bottom plate segment positioned to the rear side of the center bottom plate segment; the front, center, and rear bottom plate segments are formed integrally by welding; and the plate thickness of the center bottom plate segment is thicker than the plate thickness of the front bottom plate segment and the rear bottom plate segment.

Advantageous Effects of Invention

According to the invention as in claim 1, the strength of the swing motor mounting portion of the bottom plate can be improved, the overall increase in weight of the bottom plate can be controlled, and moreover, the yield rate of the material of the base plate is not caused to deteriorate, whereby the invention contributes to holding costs down.

DESCRIPTION OF EMBODIMENTS OF THE INVENTION

Figure 1:
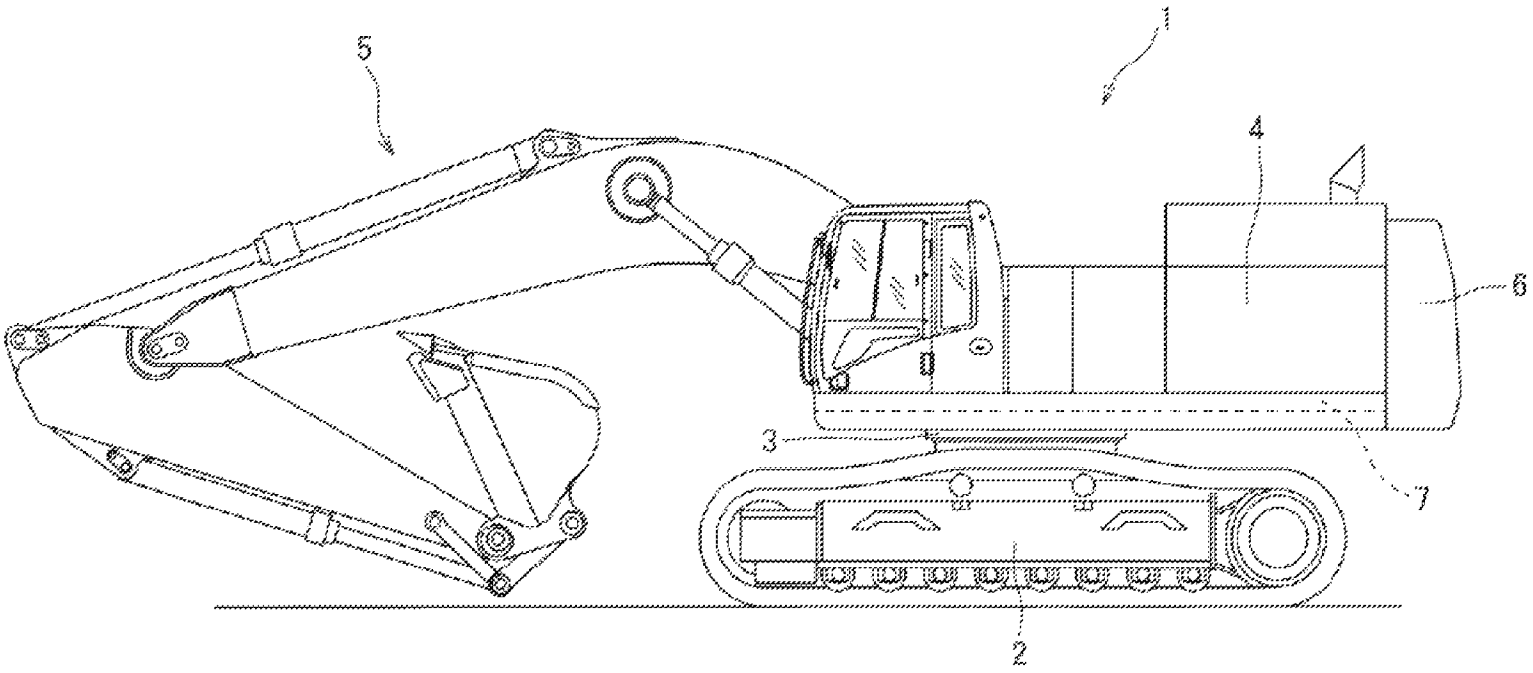
FIG. 1 is a side view of a hydraulic shovel.
Figure 2:
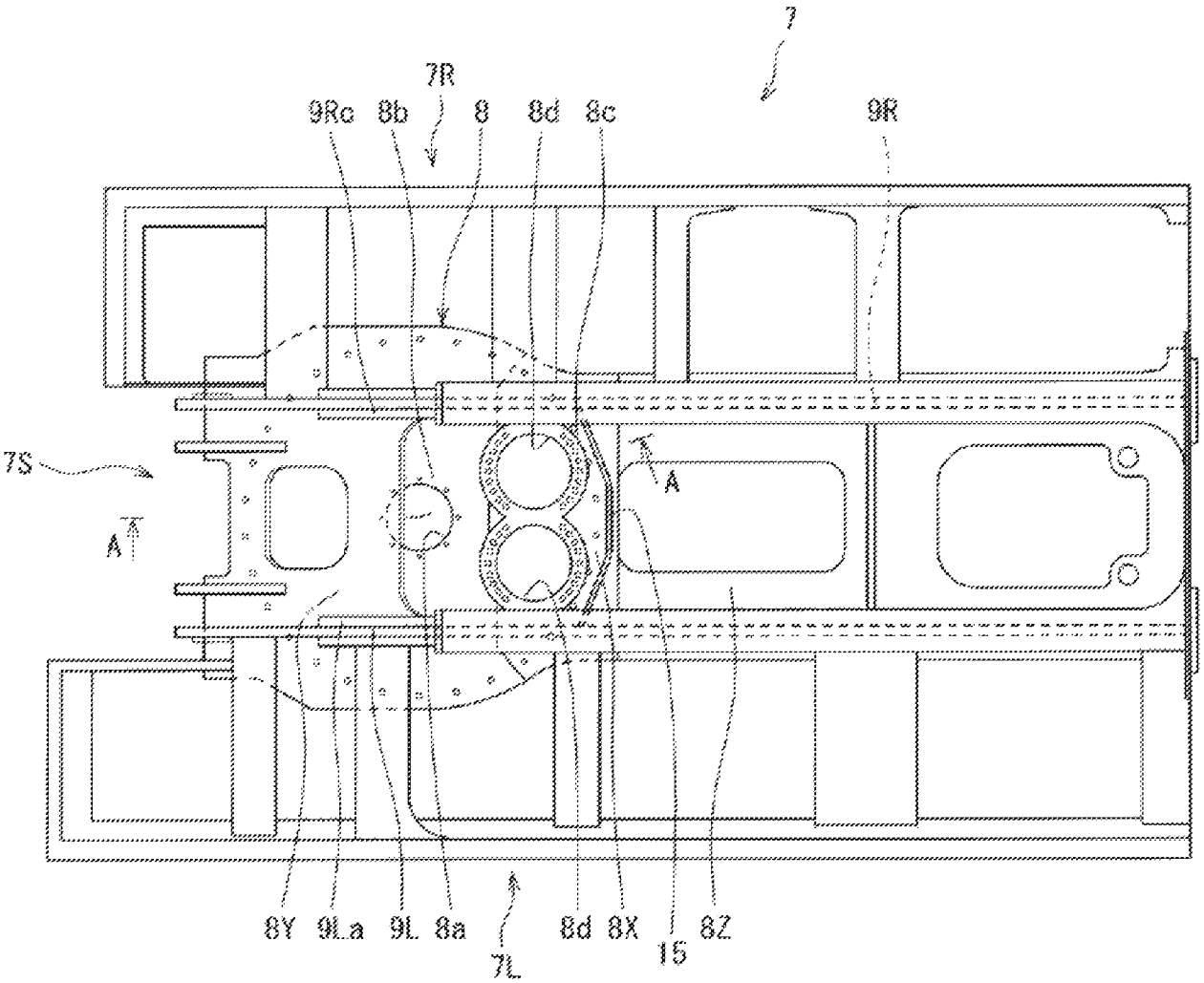
FIG. 2 is a planar view of a swing frame.
Figure 3A:
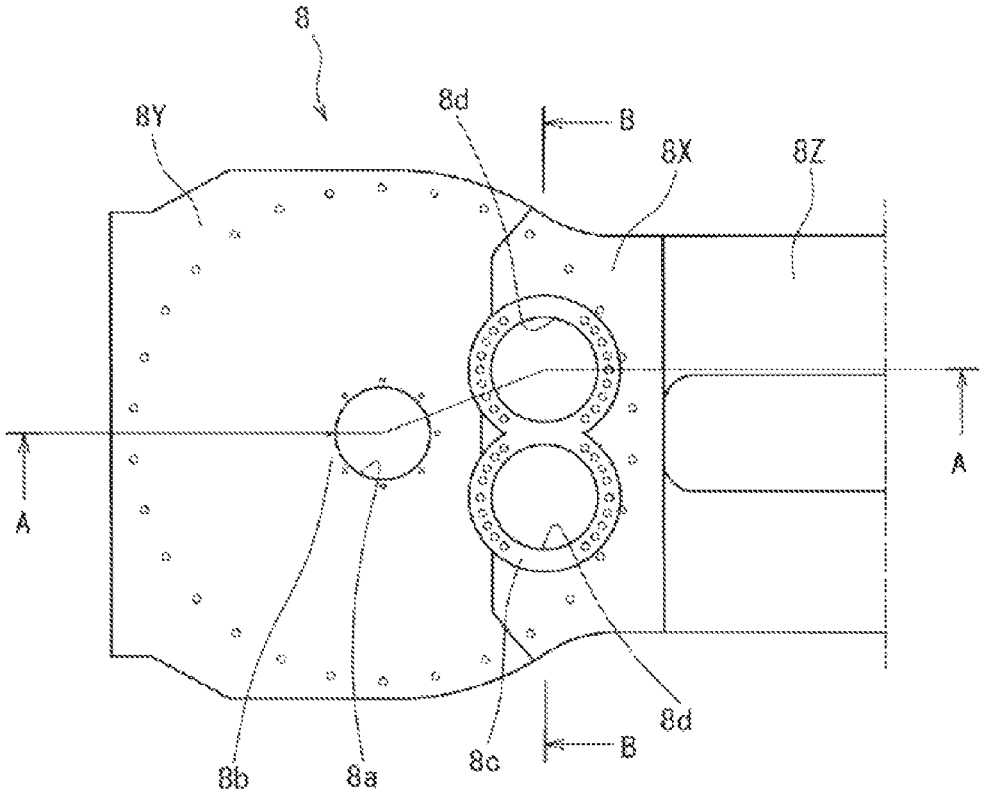
FIG. 3 shows: (A), a planar view of a bottom plate; (B), a cross-sectional view of A-A; and (C), a cross-sectional view of B-B.
Figure 3B:
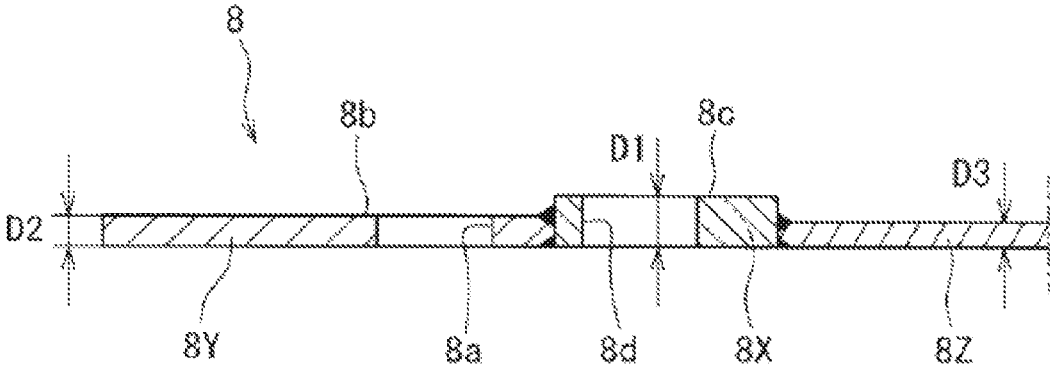
Figure 3C:
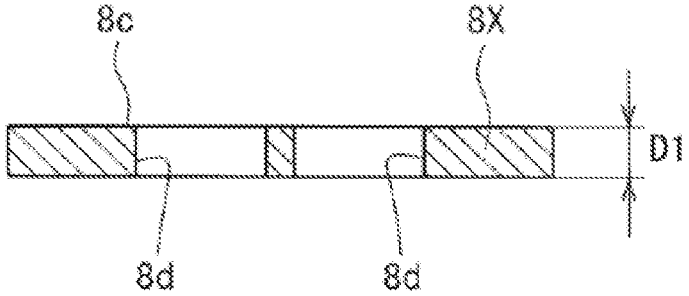
Figure 4:
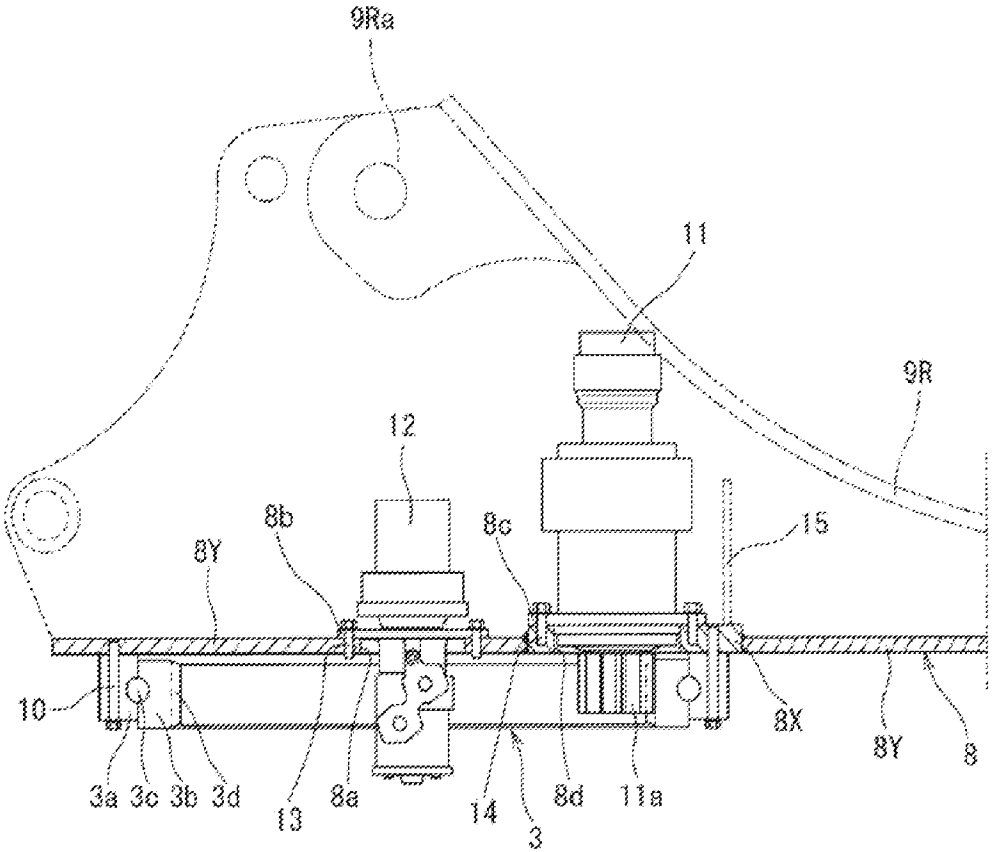
FIG. 4 is a cross-sectional view of A-A of FIG. 2 in which the swing bearing, center joint, and swing motor mounting apparatus are attached.

Embodiments of the present invention are described next, with reference to the drawings. FIG. 1 shows a hydraulic shovel 1 which is an example of a shovel-type construction machine, said hydraulic shovel 1 being characterized in that an upper swing body 4 is supported above a crawler-type bases carrier 2 via a swing bearing 3 so as to be freely rotatable, an operation apparatus 5 for carrying out various operations such as excavation and the like is attached to the front portion of the upper swing body 4, and a counterweight 6 for maintaining balance of the machine body during operation is mounted to the rear portion of the upper swing body 4.

7 is a swing frame that serves as a base of the upper swing body 4. Said swing frame 7 is configured by: a center frame 7S forming a center portion in the left-right direction; and a pair of left and right side frames 7L, 7R provided on the left and right sides of the center frame 7; wherein, said center frame 7 is further provided with a bottom plate 8 on which the swing bearing 3 is mounted, and a pair of left and right vertical frames 9L, 9R erected on said bottom plate 8. Said pair of vertical frames 9L, 9R extends in the front-back direction, and the front portions thereof form operation apparatus support portions 9La, 9Ra for supporting the base end portions of the operation apparatus 5.

Here, the swing bearing 3 is configured from an outer race 3*a* fastened to the bottom face of the bottom plate 8 of the swing frame 7 using bolts 10, an inner race 3*b* fastened to the base carrier 2 with bolts (not shown), and a plurality of bolts 3*c* threaded in-between the outer race 3*a* and the inner race 3*b*; wherein, the inner circumference of the inner race 3*b* is formed as an inner gear 3*d* for meshing with a pinion 11*a* of the swing motor apparatus 11 described below.

12 is a center joint disposed at the rotational center of the swing bearing 3. The lower-half side of said center joint 12 is disposed so as to penetrate downward through a center joint through-hole 8*a* opened on the bottom plate 8, and mounted in that state to a center joint mounting portion 8*b* provided on the bottom plate 8 by using a bolt 13. Further, the supplying and draining of hydraulic oil between the base carrier 2 and upper swing body 4 is performed through the center joint 12.

Still further, the swing motor apparatus 11 is: a motor provided with a speed reducer for driving the swing bearing 3; disposed to the rear side of the center joint 12; and attached to the swing motor apparatus mounting portion 8*c* of the bottom plate 8 using bolts 14. Yet further still, the pinion 11*a* coupled to the output axis of said swing motor apparatus 11 passes through the swing motor apparatus through-hole 8*d* opened on the swing motor apparatus mounting portion 8*c* and meshes with the above-described internal gear 3*d* of the swing bearing 3, whereby the it becomes possible for the upper swing body 4 to be rotated with respect to the base carrier 2 on the basis of the forward/reverse driving of the swing motor apparatus 11. Note that, according to the present embodiment, the swing motor is provided in the form of a left and right two-unit swing motor 11 with the left and right units being disposed side-by-side.

Here, the above-described bottom plate 8 is divided into three segments in the front-back direction, including the center bottom plate segment 8X on which the swing motor apparatus mounting portion 8*c* is provided, the front bottom plate segment 8Y that is positioned to the front side of said center bottom plate segment 8X and on which the center joint is provided, and the rear bottom plate segment 8Z positioned to the rear side of the center bottom plate segment 8X; wherein, the aforementioned bottom plate segments 8X, 8Y, and 8Z are formed integrally by welding. In this case, in order to make the thickness (D1) of the center bottom plate segment 8X a thickness that has a strength capable of withstanding the stress acting on the swing motor mounting portion 8*c* during rotation, the thickness D1 is set so as to be thicker than the plate thickness of the front and rear bottom plate segments 8Y, 8Z (D2, D3), such that D1>D2, D1>D3, whereby the strength of the swing motor apparatus mounting portion 8*c* can be secured, and the overall increase in the weight of the bottom plate controlled.

Further, the bottom plate segments 8X, 8Y, 8Z are welded together so that the bottom surface thereof is a uniform surface, whereby the bottom surface of the bottom plate 8 formed by welding together the bottom plate segments 8X, 8Y, 8Z forms the mounting seat surface of the swing bearing 3 (outer race 3*a*); however, said mounting seat surface for the swing bearing 3 is subjected to a machining process, etc., for smoothing after welding to secure a flatness thereof. Further, the plate thicknesses (D2, D3) of the front and rear bottom plate segments 8Y, 8Z are respectively set so as to secure a required degree of strength thereof; here, in the current embodiment, the plate thickness (D2) of the front bottom plate segment 8Y is set to be slightly thicker than the plate thickness (D3) of the rear bottom plate segment 8Z, but said plate thickness can also be set so as to be the same. Still further, according to the current embodiment, the shape of the front edge portion of the center bottom plate segment 8X is formed so as to be a curved line corresponding to the shape of the front edge portion of the mounting seat surface of the swing motor apparatus mounting portion 8*c*, in correspondence to which the shape of the rear edge portion of the front bottom plate segment 8Y is also formed in a curved line. In addition, 15 in the drawings is a coupling plate for being coupled between the left and right vertical frames 9L, 9R for reinforcement thereof; wherein, said coupling plate 15 is erected on the center bottom plate segment 8X.

As described above, according to the configuration of the current embodiment: disposed on a bottom plate 8 for configuring a swing frame 7 of an upper swing body 4 are a swing bearing 3, a center joint 12 which is disposed at the rotational center of said swing bearing 3 and performs supplying and draining of hydraulic oil between the base carrier 2 and the upper swing body 4, and a swing motor apparatus 11 which is disposed to the rear side of said center joint and drives the swing bearing; said bottom plate 8 is divided into a center bottom plate segment 8X on which the swing motor apparatus mounting portion 8*c* is provided, a front bottom plate segment 8Y that is positioned on the front side of said center bottom plate segment 8X and on which the center joint mounting portion 8*b* is provided, and a rear bottom plate segment 8Z positioned to the rear side of the center bottom plate segment 8X; and the center, front, and rear bottom plate segments 8X, 8Y, 8Z are formed integrally by welding; wherein, the plate thickness of the center bottom plate segment 8X is thicker than the plate thickness of the front bottom plate segment 8Y and the rear bottom plate segment 8Z.

According to the current embodiment of the present invention: by making the plate thickness of the center bottom plate segment 8X, on which the swing motor apparatus mounting portion 8*c* is provided, so as to be thick, even if the swing motor apparatus is not provided with a reinforcement plate, the strength of the swing motor apparatus mounting portion 8*c*, which is a portion on which a large amount of stress is concentrated during rotating, can be improved; and by making the plate thickness of the front and rear bottom plate segments 8Y, 8Z positioned to the front and rear of the center bottom plate segment 8X, respectively, thinner than that of the center bottom plate segment 8X, it becomes possible to control the overall increase in weight of the bottom plate 8. Here, in making the plate thickness of the swing motor apparatus mounting portion 8*c* thick: the bottom plate 8 is divided into a center, front side, and rear side as the three center, front, and rear segments 8X, 8Y, 8Z; the bottom plate segments 8X, 8Y, and 8Z are welded together as an integral unit to form the bottom plate 8; and the plate thickness of the center bottom plate segment 8X, on which the swing motor apparatus mounting portion 8*c* is provided, is made thicker than the plate thickness of the front bottom plate segment 8Y that is positioned to the front side of the center bottom plate segment 8X and on which the center joint mounting portion 8*b* is provided, and the plate thickness of the rear bottom plate segment 8Z positioned to the rear side of the center bottom plate segment 8X. Thus, there is no time and effort consumed by processing, and the yield rate of the materials is not caused to deteriorate as in the case where the plate thickness of the swing motor apparatus mounting portion is made thick by subjecting the steel plate member serving as the material for forming the bottom plate to a milling process or the like in order to remove material and thereby make a thin portion and a thick portion thereon, whereby it becomes possible to make the plate thickness of the swing motor apparatus mounting portion 8*c* thick, and to contribute to keeping the cost down.

Figure 5A:
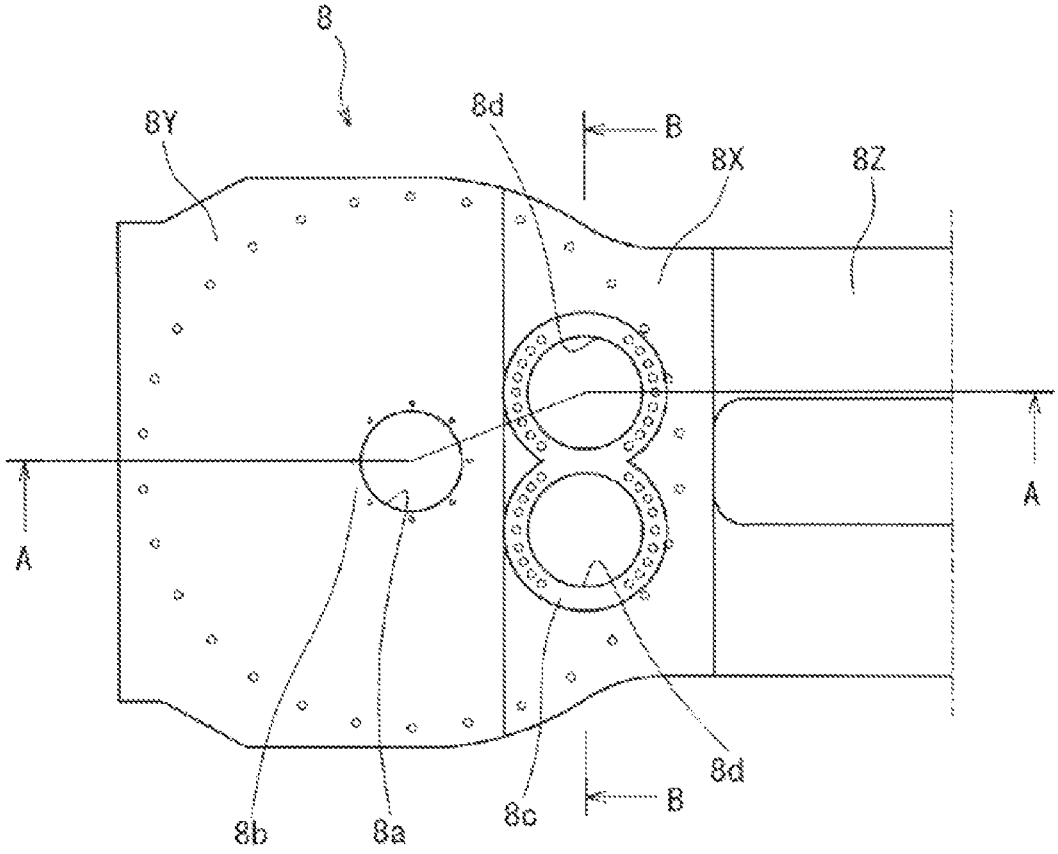
FIG. 5 shows: (A), a planar view of the bottom plate of the second embodiment; and (B), a cross-sectional view A-A of (A).
Figure 5B:
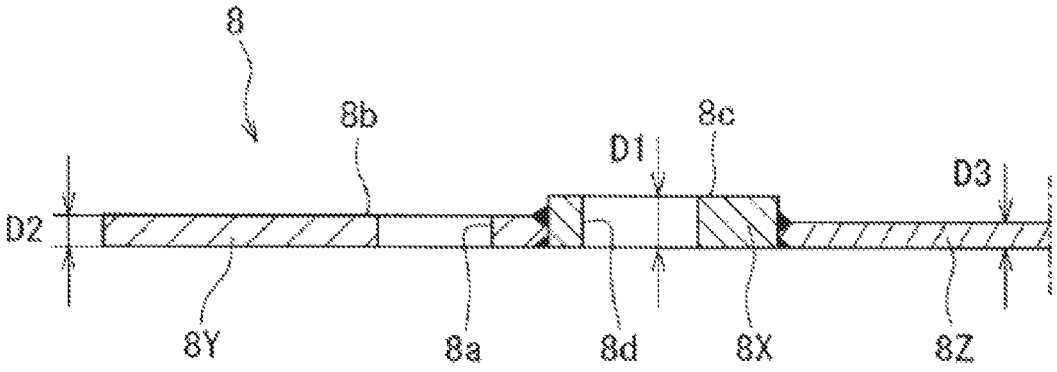

Note that the present invention is not limited to the above-described embodiment. According to the above-described embodiment, the shape of the front edge portion of the center bottom plate segment 8X is formed as a curved line corresponding to the front edge portion of the mounting seat surface of the swing motor apparatus mounting portion 8*c*; however, as per the second embodiment of the bottom plate shown in FIG. 5, the front edge portion of the center bottom plate segment 8X can also be formed in the shape of a straight line. Further, according to the above-described embodiment, dual left-and-right swing motor apparatuses are provided; however, it goes without saying that the present invention can be implemented as an embodiment in which only a single swing motor apparatus is provided.

INDUSTRIAL APPLICABILITY

The present invention is applicable to shovel-type construction machines, such as hydraulic shovels and the like, wherein the bottom plate for configuring the swing frame is provided with a swing motor mounting portion.

REFERENCE SYMBOLS

1. Hydraulic shovel
2. Base carrier
3. Swing bearing
4. Upper swing body
7. Swing frame
8. Bottom plate
8X. Center bottom plate segment
8Y. Front bottom plate segment
8Z. Rear bottom plate segment
8*b*. Center joint mounting portion
8*c*. Swing motor apparatus mounting portion
11. Swing motor apparatus
12. Center joint

The invention claimed is:

1. A construction machine comprising:

an upper swing body having a swing frame;

a bottom plate coupled to the swing frame and configured to support the upper swing body on a base, carrier;

a swing bearing mounted to the bottom plate, wherein the upper swing body, the swing frame, and the bottom plate are freely rotatable relative to the base carrier via the swing bearing;

a center joint disposed at a rotational center of the swing bearing, the center joint configured to supply and drain hydraulic oil between the base carrier and the upper swing body, and a swing motor apparatus positioned rearward of the center joint and configured to drive the swing bearing, wherein:

the bottom plate is divided into a center bottom plate segment to which the swing motor apparatus mounting portion is attached, a front bottom plate segment that is positioned forward of the center bottom plate segment and to which the center joint mounting portion is attached, and a rear bottom plate segment positioned rearward of the center bottom plate segment;

the front, center, and rear bottom plate segments each having a forward peripheral face and an opposite rearward peripheral face;

the front, center and rear bottom plate segments are formed integrally by welding such that the rearward peripheral face of the front bottom plate segment adjoins the forward peripheral face of the center bottom plate segment, and the rearward peripheral face of the center bottom plate segment adjoins the forward peripheral face of the rear bottom plate segment; and the plate thickness of the center bottom plate segment is thicker than the plate thickness of the front bottom plate segment and the rear bottom plate segment.

* * * * *